United States Patent [19]

Vaughan

[11] 4,439,293

[45] * Mar. 27, 1984

[54] ELECTRODIALYTIC PURIFICATION PROCESS

[76] Inventor: Daniel J. Vaughan, 36 Paxon Dr., Wilmington, Del. 19803

[ * ] Notice: The portion of the term of this patent subsequent to Apr. 20, 1999 has been disclaimed.

[21] Appl. No.: 350,415

[22] Filed: Feb. 19, 1982

Related U.S. Application Data

[63] Continuation-in-part of Ser. No. 241,520, Mar. 9, 1981, Pat. No. 4,325,792.

[51] Int. Cl.[3] ..... B01D 57/02

[52] U.S. Cl. ..... 204/180 P; 204/151; 204/301

[58] Field of Search ..... 204/180 P, 103, 149, 204/151, 301, DIG. 13

[56] References Cited

U.S. PATENT DOCUMENTS

| | | | |
|---|---|---|---|
| 3,788,959 | 1/1974 | Smith | 204/180 P |
| 3,926,759 | 12/1975 | Horn et al. | 204/180 P |
| 3,983,016 | 9/1976 | Ellsworth et al. | 204/89 |
| 4,049,519 | 9/1977 | Sloan | 204/180 P |
| 4,057,483 | 11/1977 | Giuffrida | 204/180 P |
| 4,111,772 | 9/1978 | Horn | 204/180 P |
| 4,325,792 | 4/1982 | Vaughan | 204/151 |

FOREIGN PATENT DOCUMENTS

| | | | |
|---|---|---|---|
| 845511 | 8/1960 | United Kingdom | 204/180 P |
| 961200 | 6/1964 | United Kingdom | 204/103 |
| 1109624 | 4/1968 | United Kingdom | 204/180 P |
| 1545702 | 5/1979 | United Kingdom | 204/180 P |
| 1574988 | 9/1980 | United Kingdom | 204/180 P |

*Primary Examiner*—R. L. Andrews
*Assistant Examiner*—Terryence Chapman
*Attorney, Agent, or Firm*—Charles J. Tonkin

[57] ABSTRACT

By using an aqueous solution of inorganic carbonate, bicarbonate and/or hydroxide as the catholyte in an electrodialysis process, acids containing a multivalent metal in the anion are prepared substantially free of anionic impurities, substantially pure electroplating-type acids with a multivalent metal in the anion such as chromic, molybdic and tungstic acids are prepared from salts of such acids and multivalent metal cations are separated from anions containing sulfur, phosphorus, halogen or carbon in aqueous solutions such as found in rinse waters from electroplating processes.

17 Claims, No Drawings

ELECTRODIALYTIC PURIFICATION PROCESS

This application is a continuation-in-part of U.S. Ser. No. 241,520, filed Mar. 9, 1981, now U.S. Pat. No. 4,325,792, issued Apr. 20, 1982.

FIELD OF THE INVENTION

This invention relates to the electrolytic separation of contaminating dissolved multivalent metal cations impurities from aqueous solutions of electroplating-type acids. More specifically, this invention is directed to an electrodialytic process wherein an aqueous solution of inorganic carbonate, bicarbonate, hydroxide and/or mixtures thereof are used as the catholyte. This process is especially useful in the electrolytic purification of electroplating solutions of chromic, molybdic, tungstic and the like acids and mixtures thereof. The process is also applicable to the separation of multivalent metal cations from anions containing sulfur, phosphorus, halogen or carbon in aqueous solutions such as found in rinse waters from electroplating processes, whereby toxic metal cations can be removed and valuable electroplating solutions recovered. The process can also be employed for the preparation of substantially pure acids containing a multivalent metal in the anion portion of the acid by electrodialysis of the salts of such acids.

BACKGROUND OF THE INVENTION

Purification of chromium plating solutions using electrodialysis is well-known in the art (see U.S. Pat. Nos. 3,481,851; 3,909,381; and 4,006,067, the disclosures of which are hereby incorporated by reference). Electrodialysis is the transport of ions through an ion permeable membrane as a result of an electrical driving force, and the process is commonly carried out in an electrodialysis cell having an anolyte compartment and a catholyte compartment separated by a permselective membrane. The permselective membranes are not unlike ion exchange resins in sheet or membrane form. They comprise a matrix of a chemically inert resin throughout the polymer lattice of which are distributed chemically bound anionic or cationic moieties having fixed negative and positive charges. Anion permeable membranes have positive (cationic) fixed charges distributed throughout the polymer lattice and, as the name implies, are permeable to negatively charged ions and are relatively impermeable to positively charged ions. Unfortunately, there are no known anion permeable membranes that are 100% impermeable to cations, and there are no known cation permeable membranes that are 100% impermeable to anions. As a result, there is always in every electrodialysis process some small degree of reverse migration of cations through the anion permeable membrane and/or of anions through the cation permeable membrane.

U.S. Pat. No. 3,481,851 teaches that the dissolved metallic contaminants can be removed from the aqueous chromium plating solution by electrodialysis. An electric current is passed between the anode and the cathode of the cell through the aqueous solutions contained in the anolyte and catholyte compartments of the cell. The electric current causes the contaminant metal cations (for example, iron and copper ions) present in the chromic acid solution to migrate from the anolyte compartment through the cation permeable membrane into the catholyte compartment, reverse migration of anions (for example, chloride ions) being prevented, in theory at least, by the cation permeable membrane. This process effectively reduces the concentration of contaminant metal cations in the chromic acid solution to acceptable levels. In addition, the electrolytic oxidizing conditions prevailing in the anolyte quickly oxidizes the trivalent chromium present therein to the hexavalent state, thereby reducing the ratio of trivalent to hexavalent chromium to an acceptable level. However, the cation permeable membrane also permits the reverse migration of a small amount of mineral acid anions (e.g., chloride or sulfate anions) from the catholyte to the anolyte compartment and as a consequence there is a fairly rapid build-up of these anions in the chromium plating solution. The build-up of mineral acid anions in the anolyte quickly renders the chromic acid solution unsuitable for chromium plating. Therefore, while this process will effectively remove harmful metal cations (for example, iron and copper ions) from the chromium plating solution, it also results in the rapid build-up of equally harmful mineral acid anions (for example, chloride ions) in the plating solution. As a result, this process does not provide a satisfactory solution to the problem of rejuvenating chromium plating solutions by the removal of contaminant metal cations therefrom.

U.S. Pat. No. 3,909,381 teaches that the metallic contaminants can be removed from the chromium plating systems in an electrodialysis cell wherein the catholyte comprises an aqueous solution of at least one ionizable organic compound and wherein the anions of the ionizable organic compounds in the catholyte are oxidized to gaseous oxidation products and water when reacted with the chromic acid-containing anolyte thereby reducing the anion contaminants in the anolyte. However, the oxidation of the organic compound results in the reduction of hexavalent chromium to a lower valent chromium which has an adverse effect on the plating performance of the chromium solution. In addition the electrical conductivity of aqueous solutions of organic compound salts is low and, in turn, limits the capacity and electrical efficiency of the electrodialysis cell.

In electroplating of metals for example, using chromic acid, sulfuric acid is added to the plating solution. A typical plating bath would contain about 250 gram/liter of chromic acid and 2.5 grams/liter of sulfuric acid. The concentration of sulfuric acid relative to chromic acid concentrations increases as the chromic acid is electro deposited. The sulfuric acid concentration is generally controlled by the addition of barium carbonate to the plating solution for precipitation of the sulfate ion or by controlling the drag-out of plating solution into the rinse water. If the rinse water is evaporated, concentrated by reverse osmosis or conventional electrodialysis using both cation and anion membranes or if the rinse water is treated with ion exchange resins, there is no significant separation of sulfuric acid from the chromic acid. This, in turn, precludes operation of a closed-loop chromic acid plating system with current technology unless the chromic acid added as make up to the plating solution does not contain sulfate ions.

Chromium trioxide (chromic acid anhydride, chromic acid) is produced by the reaction of sodium dichromate with sulfuric acid or by adding a large excess of sulfuric acid to a concentrated solution or slurry of sodium dichromate. These processes produce chromic acid contaminated with sulfate ion.

As indicated above, the cation membrane permits the reverse migration of a small amount of anions. The reverse migration of anions through cation permeable membranes increases with increasing concentration of anions in the catholyte solution. The reverse migration of anions does not significantly affect cell performance in electrodialysis wherein the anion in the anolyte and catholyte is the same. However, reverse migration of an anion, for example, a hydroxyl ion, through a cation permeable membrane wherein a multivalent metal cation is simultaneously migrating through the cation membrane from the anolyte to the catholyte can result in precipitation of metal hydroxide in the membrane which can, if in sufficient quantity, cause mechanical damage to the membrane and loss in ion transport capacity. It is well known that reverse migration of hydroxyl ion in the electrolysis of sodium chloride which contains low concentrations of calcium ion causes precipitation of calcium hydroxide in the cation membrane and loss in ion transport.

In electroplating, mining and finishing of metals the aqueous solutions contain salts of multivalent metal ions such as cadmium, chromium, zinc and nickel which are classified as toxic materials. To meet pollution standards, these metals must be removed from the wastewater. It is common to treat the waste solutions with lime and other chemicals to form a sludge which is separated from waste in the solution and disposed in sludge ponds or on land fill. The waste solutions are, at times, further treated with ion exchange resins to remove traces of the toxic metal ions.

The high cost of replacing the electroplating chemicals lost in the waste treatment processes and the high and increasing cost of waste treatment and disposal of the waste dictate the need for a process which permits the recovery for reuse of the electroplating chemicals preferably a process offering reductions in energy waste treatment cost and in the quantity of waste for disposal.

Current processes directed to reducing the loss of electroplating chemicals in rinse water all operate on the same basic prinicipal of concentration of the dilute solutions to the degree that the solution can be returned to the plating bath. None of the processes provide for removal of metal cations and anionic impurities in a closed loop, continuous systems and, therefore, ion exchange or other techniques are required to prevent build up of impurities to levels affecting quality of the finished metals. The current commercial processes include evaporation, reverse osmosis, ion exchange and electrodialysis. Evaporation is broadly applicable but with high energy cost and high investment for corrision resistant equipment. Reverse osmosis is severly limited in use by rapid deterioration in performance of the separating membrane. Ion exchange is suited for processing dilute solutions but a major drawback is that the resin must be regenerated after its ion exchange capacity has been exhausted. Regeneration complicates operation, adds to the waste load, and requires a solution concentration step for return of the chemicals to the plating bath.

SUMMARY OF THE INVENTION

It has been found that using an aqueous solution of inorganic carbonate, bicarbonate, hydroxide or mixtures thereof as the catholyte permits the electrodialysis cell for the purification of electroplating multivalent metal containing acid solutions to operate at a high capacity and a high efficiency without adversely affecting the oxidation state of the multivalent metal, e.g., chromium, ions in the solution. In the process, electric current is passed through the electrodialysis cell which has a catholyte compartment containing a cathode and a catholyte and an anolyte compartment containing an anode and an anolyte, the catholyte and anolyte compartments being separated by a cation-permeable membrane. In the improved process when the carbonate, bicarbonate or hydroxide ions migrate into the acidic environment of the anolyte, they are immediately converted to carbon dioxide gas, which evolves from the anolyte, and/or water. None of the adverse effects of the prior processes is encountered when the inorganic carbonate, bicarbonate or hydroxide is used in the catholyte. The present process permits electrodialysis with high efficiency and high capacity but without adversely affecting the capacity of the electrodialysis cell by precipitation of salts in the separating membrane and the quality of the anolyte by reverse migration of anions from the catholyte to the anolyte. This electrodialysis process is especially useful for the purification of electroplating multivalent metal-containing acid solutions which are contaminated with dissolved metal cations. Also the process is particularly useful for the preparation of sulfate-free chromic acid, or molybdic acid or mixtures thereof or other electroplating multivalent metal-containing acids free from anionic impurities, from the respective salts of the desired acids. Further the electrodialysis process using aqueous solutions of water-soluble inorganic carbonate, bicarbonate, hydroxide or mixtures thereof as the catholyte is especially useful in the separation of multivalent metal cations from anions containing sulfur, phosphorus, halogen or carbon as sometimes found as impurities in electroplating solutions or electroplating rinse waters.

DETAILED DESCRIPTION OF THE INVENTION

Any water-soluble inorganic carbonate, bicarbonate or hydroxide can be used in this invention. Thus, the hydroxide can be used alone or in combination with carbonate and/or bicarbonate. Preferred cations are the alkali metal cations and ammonium cations. Particularly preferred cations are potassium, sodium and ammonium. The concentration of the inorganic carbonate or bicarbonate in the aqueous catholyte solution can be adjusted for the desired electrical conductivity. (Higher concentration of carbonate, bicarbonate or hydroxide salts gives higher electrical conductivity.) When the anolyte solution contains cations which form hydroxide precipitates, (such as iron, copper, cadmium, nickel) the hydroxide concentration in the catholyte must be maintained at a level to prevent precipitation of the cation in the membrane resulting from reverse migration of the hydroxyl ion and in turn prevent loss of cell capacity and efficiency. The acceptable hydroxide concentration in the catholyte varies with the cation and cation concentration in the anolyte and the permselectivity of the cation membrane. In general, the concentration of an alkali metal hydroxide should not exceed 10 wt. % in the catholyte when metal cations in the anolyte form hydroxide precipitates. Preferably the hydroxide concentration in the catholyte should be less than 5 wt. %. Such precipitate forming cations are normally multivalent metal ions such as copper, nickel, or chromium. The lower hydroxide concentrations are used with the higher concentrations of such precipitate forming cations. When the only cation in the anolyte is an alkali metal such as sodium or potassium or ammonium there is no restriction on the hydroxide concentration in the catholyte. The hydroxide concentration can be reduced by the addition of carbon dioxide (or $CO_2$ containing gases such as air) to the catholyte. If the electrodialysis cell becomes less efficient because of partial plugging, carbon dioxide (or other carbon dioxide-containing gases such as air) can be bubbled into the catholyte to readjust an hydroxide level which permits continuous operation of the cell. To control the hydroxide concentration, the catholyte can be continuously contacted with a carbon dioxide-containing gas to convert the excess to carbonate or bicarbonate.

Mixtures of carbonates, bicarbonates and hydroxides may be used for the catholyte and the solution may contain chelating agents to complex or solubilize the metal ions, or compounds to precipitate the metal ions, or wetting and dispersing agents to aid in removal of the metal ion precipitates and the separation of hydrogen gas from the catholyte. The metal ions migrating from the anolyte to the catholyte may be removed from the catholyte by precipitation and filtration and by plating on the cathode.

The membranes are preferably cation exchange membranes including hydrocarbons and halocarbon polymers containing acids and acid derivatives of sulfur, carbon and phosphorus. The preferred membranes are substantially chemically stable to the process conditions, mechanically and chemically suitable for economical design and operation of the electrolytic process. Preferred for a strong oxidizing medium is the perfluorocarbon membrane, such as Nafion ®, a perfluorocarbon polymer containing sulfonic acid groups and perfluorocarbon polymers containing carboxylic or phosphonic acid groups.

One aspect of the invention relates to the electrolytic purification of aqueous solutions of chromic acid and other electroplating multivalent metal-containing acids such as molybdic and tungstic acid and mixtures thereof. Particularly preferred are solutions of chromic acid and molybdic acid and mixtures thereof contaminated with dissolved metal cations such as copper.

To illustrate the practice of the above aspect of the invention, a cell was assembled having an anolyte compartment containing an anode and a catholyte compartment containing a cathode with the anolyte compartment being separated from the catholyte compartment by a cation permeable membrane. The cell had an electrolysis area of 3.14 $in^2$ (1 inch in diameter) and was equipped with an anode made from lead, a cathode made from 316 stainless steel. The cation membrane was Nafion ®427 (obtained from duPont Company). To the assembled cell was added a catholyte solution comprising 10 grams of sodium carbonate, 42 grams of sodium bicarbonate in 500 ml of solution. (An aliquot of the solution was titrated with hydrochloric acid to the methyl red endpoint—the solution was 1.38 normal.) An anolyte comprising 39 grams of chromium trioxide, 6 grams cupric sulfate ($CuSO_4.5H_2O$) and 3 grams sulfuric acid in 400 ml water with 0.52 grams oxalic acid was added to reduce some six valent chromium to three valent chromium. The anolyte solution was brown in color. A current of three (3) amperes was applied for a period of three hours. The anolyte solution turned a deep red-orange (characteristic of chromic acid). The catholyte solution was a light blue (probably from a copper complex).

Copper (0.2 g) was deposited on the cathode and 0.9 g copper calculated as cupric carbonate $CuCO_3$ was filtered from the catholyte solution. At the end of the experiment, an aliquot of the catholyte was titrated to a methyl orange end point. The solution was 1.4 normal, indicating that there was substantially no transport of sodium from the catholyte to the anolyte. The membrane remained clear indicating essentially no precipitation of copper or other salts in the membrane. This example shows the ease with which chromium plating solutions can be purified by means of this invention.

Another aspect of this invention relates to the simultaneous preparation and purification of acids containing a multivalent metal in the anion substantially free of anionic impurities, using an aqueous solution of an inorganic carbonate, bicarbonate, hydroxide and/or mixtures thereof as the catholyte and an aqueous solution of a salt of the desired acid as the anolyte. This allows the preparation from the salts substantially pure chromic, tungstic or molybdic and like acid or mixtures thereof. It is particularly useful in the preparation of sulfate-free chromic acid or molybdic acid or mixtures thereof. For example, the present electrodialysis of an aqueous solution of sodium chromate or sodium molybdate or mixtures thereof as the anolyte across a perfluorocarbon membrane containing sulfonic acid groups (as described hereinabove), using an aqueous solution of water-soluble inorganic carbonate, bicarbonate or hydroxide or mixtures thereof as the catholyte, permits the production of aqueous chromic acid or molybdic acid or mixtures thereof substantially free of anion impurities. In the process the sodium cation and cation impurities (e.g., iron, copper and chromium) migrate from the anolyte to the catholyte.

Any water-soluble salt having an anion containing a multivalent metal can be used in this invention. Preferably the cation portion of the salt is monovalent such as alkali metal cation or ammonium cation. Particularly preferred cations are sodium, potassium and ammonium. Preferably the multivalent metal in the anion is in the +4 or +6 valent state. The most preferred anions are chromate, molybdate, and tungstate. The concentration of the aqueous anolyte solution can be adjusted to obtain the desired concentration of the metal ion-containing acid in the anolyte. The anolyte may contain additives, for example, additives which are suitable for use in electroplating or finishing of metals. The anolyte solutions can comprise two or more salts of different cations and different anions. This preparation of acids from their salts can be carried out simultaneously with electroplating and finishing of metals or in a separate operation.

To illustrate the practice of this aspect of the invention, a cell was assembled having an anolyte compartment containing an anode and a catholyte compartment containing a cathode with the anolyte compartment being seperated from the catholyte compartment by a cation permeable membrane. The cell had an electrolysis area of 3.14 $in^2$ (1 inch in diameter) and was equipped with an anode made from lead and a cathode made from stainless steel. The cation permeable membrane was Nafion ®324 membrane (obtained from duPont Company). To the assembled cell was added a catholyte solution and an anolyte solution. A current of one half (0.5) ampere was applied for a period of three hours. The anolyte solution was used to plate steel coupons. An aliquot of the catholyte solution was titrated to the methyl orange end point, when the cation in the anolyte was sodium or ammonium. When the cation in the anolyte was cadmium or copper, the catholyte was filtered, the filtrate titrated to the methyl end point with standard hydrochloric acid and the precipitate air dried and weighed.

Anolyte solutions and catholyte solutions of approximately equal volume were added to the assembled cell are as follow: Run #1: anolyte comprising 200 grams/liter of reagent grade sodium chromate; catholyte 40 grams/liter of reagent grade sodium hydroxide. Run #2: anolyte comprising 200 grams/liter of sodium molybdate and catholyte 100 grams/liter of sodium carbonate. Run #3: anolyte comprising 100 grams/liter of sodium chromate and 100 grams/liter of sodium molybdate, a catholyte of 50 grams/liter of sodium carbonate. Run #4: anolyte comprising 100 grams/liter of sodium tungstate and catholyte containing 20 grams per liter of sodium carbonate and 94 grams per liter of sodium bicarbonate. Run #5: anolyte 200 grams of ammonium paramolybdate, catholyte 57 grams per liter of ammonium carbonate, 50 grams per liter of sodium carbonate. Run #6: anolyte comprising 10 grams of copper dichromate, 100 grams of sodium dichromate, catholyte 20 grams per liter of sodium carbonate and 84 grams per liter of sodium bicarbonate.

After operation of the cell, the anolyte and catholyte solutions were removed from the cell. The anolyte solutions from Run #1 and Run #3 were used to electroplate steel coupons. Sulfuric acid, corresponding to about 2.0 grams per liter was added to the anolyte solution. The anolyte solution was heated to 130° F. in an electroplating bath comprising a lead anode and a current of 6.5 amperes per square inch was applied for one hour. The steel coupon plated from anolyte Run #1 was standard for chrome plating. The steel coupon plated with anolyte Run #3 was a metallic grey in appearance and the plating analyzed as 0.5% molybdenum and 99.5% chromium. The anolyte solution of Run #1 was a deep red-orange (characteristic of chromic acid). The anolyte solution of Run #3 was a deep brick red characteristic of a mixture of chromic and molybdic acid. The catholyte solution from Run #1 was 1.0 normal before electrolysis and 1.8 normal after electrolysis indicating substantial transport of sodium ion from the anolyte to the catholyte. The catholyte solution from Run #3 was 1.0 normal before electrolysis and 1.7 after electrolysis.

Run #2—The anolyte solution was a deep red-orange. The catholyte was 2 normal before electrodialysis and 3 normal after.

Run #4—After electrolysis anolyte was a faint yellow-green. The catholyte was 1.28 normal before and 1.9 normal after electrolysis. The catholyte contained a low concentration of a blue-green precipitate indicative of a cation impurity in the reagent grade sodium tungstate.

Run #5—The anolyte before electrolysis was colorless and after electrolysis a light yellow. The catholyte solution was 2 normal before electrolysis and 2.5 normal after electrolysis.

Run #6—The anolyte solution before electrolysis was a brownish yellow and after electrolysis a deep red-orange characteristic of chromic acid. The catholyte solution was 1.28 normal and colorless before electrolysis and after electrolysis the catholyte was 1.7 normal and contained about 3 grams/liter of a blue precipitate characteristic of copper carbonate or cupric hydroxide.

These results indicate the ease of making acids of an anion containing a multivalent metal cation and mixtures of these acids which are substantially pure and free of impurities such as mineral acid anions, e.g., sulfate ions and chloride ions and multivalent cation impurities from the salts of these acids.

Another aspect of the invention relates to the electrodialysis process using aqueous solutions of water-soluble inorganic carbonate, bicarbonate, hydroxide or mixtures thereof as the catholyte in the separation of multivalent cations from one or more anions containing sulfur, phosphorus, halogen and/or carbon as sometimes found in electroplating solutions or electroplating rinse waters. This process is especially suited for recovery of multivalent metal cations from aqueous solutions common in the metal industry, electroplating and finishing of metals, purification of acids containing dissolved metallic impurities and regeneration and purification of solutions associated with the use of ion exchange processes. Such recovery is accomplished without significant precipitation of the multivalent metal ion in the cation permeable membrane, or loss in performance or capacity of the electrolytic process. When the carbonate, bicarbonate and/or hydroxide ions migrate into the acidic environment of the membrane or the anolyte, they are converted to water and/or carbon dioxide gas which evolves from the anolyte. The multivalent metal ion migrating from the anolyte across the membrane to the catholyte is precipitated as the hydroxide, carbonate or bicarbonate. If desired, the precipitated multivalent metal salt may be removed from the catholyte solution, allowing the purified anolyte solution to be reused in the electroplating, metal finishing and metal refining processes and the reclaiming of the multivalent metal cations as well as the removal of toxic multivalent metal cations from waste waters. Recovery of the precipitates can be accomplished by filtration, centrifuging or other separation techniques.

The anolyte solution can be an aqueous solution comprising any water-soluble salt of a multivalent metal cation and anions containing sulfur, halogen, phosphorus and/or carbon. The multivalent cation can be one or more of the multivalent metals from the transition elements, groups 1*a*, 2*b*, 3*a*, 4*a* and 5*a* and rare earth elements of the Periodic Table. The preferred multivalent metal ions are nickel, copper, zinc, aluminum, cadmium, tin, antimony, bismuth and chromium. The preferred anions are sulfate, chloride, phosphate and carboxylate. The concentration of the anolyte solution may be varied over a broad range (saturated solutions to solutions containing one weight percent or less). The anolyte solutions can contain additives to solubilize the metal salts, to chelate or complex ions or to precipitate impurities.

By this process, the multivalent metal ions such as cadimum, chromium, zinc and nickel which form toxic materials can be readily removed from waste waters.

To illustrate the practice of this aspect of the invention, a cell was assembled having an anolyte compartment containing an anode and a catholyte compartment containing a cathode with the anolyte compartment being separated from the catholyte compartment by a cation permeable membrane. The cell had an electrolysis area of 3.14 $in^2$ (1 inch in diameter) and was equipped with an anode made from graphite and a cathode made from stainless steel. The cation membrane was Nafion®324 (obtained from duPont Company). To the assembled cell was added a catholyte solution comprising 10 grams of sodium carbonate and 42 grams of sodium bicarbonate in 500 ml of water. (An aliquot of the solution was titrated to the methyl orange end point—the solution was 1.38 normal.) To the assembled cell was added an anolyte in several different tests solutions comprising different salts of a multivalent metal cation and an anion. Each solution was made by adding twenty grams (20) of a multivalent metal cation salt to 100 ml of water. An aliquot of the solution was added to the anolyte compartment of the cell. The different anolyte solutions used contained, respectively, aluminum, nickel, cupric, cadmium or zinc sulfate, cupric acetate, cadmium or copper chloride, or cadmium phosphate. A current of one (1) ampere was applied for a period of three hours. An aliquot of the catholyte was filtered and titrated to a methyl orange end point. The membrane was examined for precipitates after each electrolysis.

The membrane remained clear when processing all of the anolyte solutions indicating essentially no precipitation of metal cation salts in the membrane. The catholyte solutions filtered to remove the precipitates was 1.4 to 1.5 normal, indicating that there was substantially no transport of sodium from the catholyte to the anolyte. The catholyte contained precipitates of the metal cations that had color characteristic of the metal hydroxides, carbonates or bicarbonates of each metal ion. Chlorine gas was evolved during the electrolysis of metal salts containing chloride ions. The anolyte solutions containing sulfate, acetate and phosphate increased in acidity with the electrolysis. These examples show the ease with which aqueous solutions of salts of multivalent metal cations and anions containing sulfur, phosphorus, carbon and halogen can be electrodialytically separated across a cation permeable membrane using an aqueous solution of inorganic carbonate or bicarbonate or hydroxide as the catholyte.

The foregoing examples illustrate the practice of this invention. They are presented solely for the purpose of illustrating the invention and are not in any way to be construed as limiting the scope of the invention.

I claim:

1. In an electrodialysis process of passing an electric current through an electrodialysis cell comprising (a) a catholytic compartment containing a cathode and a catholyte, (b) an anolyte compartment containing an anode and an anolyte comprising an acidic aqueous solution containing dissolved multivalent metal cations and selected from (1) aqueous electroplating-type acids, (2) aqueous salt of a cation and an anion containing a multivalent metal ion, (3) aqueous salt of a multivalent metal cation and an anion of an acid containing sulfur, phosphorus, halogen or carbon, and (4) mixtures thereof, (c) the anolyte and catholyte compartments being separated by a cation-permeable membrane, the improvement comprising employing as the catholyte an aqueous solution of an inorganic carbonate, bicarbonate or hydroxide or mixtures thereof which form carbon dioxide and/or water upon contact with said acidic anolyte, whereby the electrodialysis can be carried out at high efficiency and high capacity without adversely affecting the capacity of the electrodialysis cell by precipitation of salts in the separating membrane and the quality of the anolyte by reverse migration of anions from the catholyte to the anolyte.

2. The process of claim 1 wherein said catholyte comprises a water soluble inorganic hydroxide and the concentration of said hydroxide is maintained at less than that which under the operating conditions causes formation of significant amounts of insoluble multivalent metal cation hydroxides in said membrane.

3. In the electrolytic purification of an aqueous solution of electroplating-type acids containing a multivalent metal ion in the anion portion of said acid, which solution is contaminated with dissolved multivalent metallic cations by passing electric current through an electrodialysis cell comprising (a) a catholyte compartment containing a cathode and a catholyte and (b) an anolyte compartment containing an anode and an anolyte comprising said contaminated acid solution, the anolyte and catholyte compartments being separated by a cation-permeable membrane, the improvement comprising employing as the catholyte an aqueous solution of a water-soluble inorganic carbonate, bicarbonate, hydroxide and/or mixtures thereof which forms carbon dioxide and/or water on contact with the anolyte, and transporting said multivalent metal cation contaminants from the anolyte through said membrane into said catholyte for reaction therein with the carbonate, bicarbonate and/or hydroxide and wherein the concentration of said hydroxide is maintained at sufficiently less than 5 wt. percent to minimize formation of insoluble hydroxides in said membrane whereby a high-capacity, efficient electrodialytic purification can be carried out without adversely affecting the oxidation state of the metal ions in the anolyte.

4. The purification according to claim 3 wherein the inorganic carbonate or bicarbonate is an alkali metal carbonate, an alkali metal bicarbonate, ammonium carbonate, or ammonium bicarbonate.

5. The purification according to claim 4 wherein the inorganic carbonate or bicarbonate is sodium carbonate, ammonium carbonate, sodium bicarbonate, potassium bicarbonate, or ammonium bicarbonate.

6. The purification according to claim 3 wherein said catholyte is a water-soluble inorganic hydroxide in admixture with water-soluble inorganic carbonate or bicarbonate.

7. The purification according to claim 3 wherein said anolyte acid solution comprises chromic acid, molybdic acid, tungstic acid or mixtures thereof.

8. The purification according to claim 3 wherein said catholyte contains a water-soluble inorganic hydroxide and the concentration of said hydroxide is maintained at less than that which under the operating conditions causes formation of significant amounts of insoluble multivalent metal cation hydroxides in said membrane.

9. A process for the electrolytic preparation of substantially pure acids containing a multivalent metal ion in the anion portion of the acid from an aqueous solution of a salt of a cation and an anion containing a multivalent metal ion by passing electric current through a dialysis cell comprising:

(a) a catholyte compartment containing a cathode and a catholyte comprising an aqueous solution of an inorganic carbonate, bicarbonate, hydroxide, or mixtures thereof, wherein said hydroxide concentration at sufficiently less than 5 wt. percent to minimize formation of insoluble hydroxides in said membrane, (b) an anolyte compartment containing an anode and an anolyte comprising an aqueous solution of a salt of a cation and an anion containing a multivalent metal ion, and dissolved multivalent metal cation contaminants and (c) a cation permeable membrane separating said anolyte compartment from said catholyte compartment, whereby said desired acid containing a multivalent anion is obtained substantially free of anion and cation impurities, whereby said multivalent metal cation contaminants are transported from said anolyte through said membrane into said catholyte for reaction with said carbonate, bicarbonate and/or hydroxide.

10. The process of claim 9 wherein said cation is selected from alkali metals and ammonium.

11. The process of claim 9 wherein said salt cation is a monovalent inorganic metal.

12. The process of claim 9 wherein said salt anion is selected from chromate, molybdate, tungstate and mixtures thereof.

13. The process of claim 12 wherein said anolyte comprises said salt substantially free of sulfate and chloride ions, whereby said desired acid is obtained substantially free of said sulfate and chloride ions.

14. An electrolytic process for the separation of a salt of a multivalent metal cation and an anion of an acid containing sulfur, phosphorus, halogen or carbon by converting said salt into the hydroxide, carbonate or bicarbonate salt of said multivalent metal cation and the acid of said anion by passing electric current through an electrodialysis cell comprising (a) a catholytic compartment containing a cathode and a catholyte of an aqueous solution of water-soluble inorganic carbonate, bicarbonate, hydroxide or mixtures thereof, wherein the concentration of said water-soluble hydroxide is maintained at less than about 5 weight percent, and (b) an anolyte compartment containing an anode and an acidic anolyte comprising an aqueous solution of said salt of a multivalent metal cation, said catholyte and anolyte compartments being separated by a cation-permeable membrane.

15. The separation according to claim 14 wherein said cation is selected from nickel, copper, zinc, aluminum, cadmium, tin, antimony, bismuth, chromium and mixtures thereof.

16. The separation according to claim 14 wherein said anion is selected from sulfate, chloride, phosphate, carboxylate, and mixtures thereof.

17. The separation according to claim 14 wherein said catholyte contains an alkali metal carbonate, alkali metal bicarbonate, ammonium carbonate, ammonium bicarbonate and/or mixtures thereof.

* * * * *